United States Patent [19]

Parker

[11] 4,447,098

[45] May 8, 1984

[54] PREVENTING TOPPLING OF CABINETS OR OTHER FURNITURE

[75] Inventor: Ray Parker, Leeds, England

[73] Assignee: Thatchcode Limited T/A Flexiform, Great Britain

[21] Appl. No.: 377,073

[22] Filed: May 11, 1982

[51] Int. Cl.[3] ..... E05B 65/46; E05C 15/04

[52] U.S. Cl. ..... 312/216; 312/107.5; 312/218; 312/221

[58] Field of Search ..... 312/215, 216, 217, 218, 312/219, 220, 221, 222, 107.5

[56] References Cited

U.S. PATENT DOCUMENTS

| | | | |
|---|---|---|---|
| 732,971 | 7/1903 | Stoeffler | 312/219 |
| 1,006,605 | 10/1911 | Tilton | 312/107.5 |
| 1,695,896 | 12/1928 | Holden | 312/216 |
| 2,286,427 | 6/1942 | Levensten | 312/222 |
| 2,547,486 | 4/1951 | Page | 312/218 |
| 2,729,498 | 1/1956 | Law | 312/216 |
| 2,992,056 | 7/1961 | Thielker | 312/221 |
| 3,454,320 | 7/1969 | Olree | 312/217 |
| 3,589,783 | 6/1971 | Studinski | 312/221 |
| 3,866,993 | 2/1975 | Dean et al. | 312/216 |

*Primary Examiner*—Victor N. Sakran

*Attorney, Agent, or Firm*—Burns, Doane, Swecker & Mathis

[57] ABSTRACT

A cabinet 10 has internal units which can be slid out of the cabinet on slides 12. The slides are mounted in slots 15 in the side walls 14, 16 of the cabinet. To prevent several of the units being slid out simultaneously, which may cause the cabinet to topple forward, a safety device 34 consisting of a number of blocking elements 36 on a guide 38 is arranged near one side of the entrance 20 to the cabinet 10. The guide 38 has a free length which enables the blocking elements to be slid along the guide to release one of the units, but which does not permit the blocking elements to be slid to release further units.

11 Claims, 7 Drawing Figures

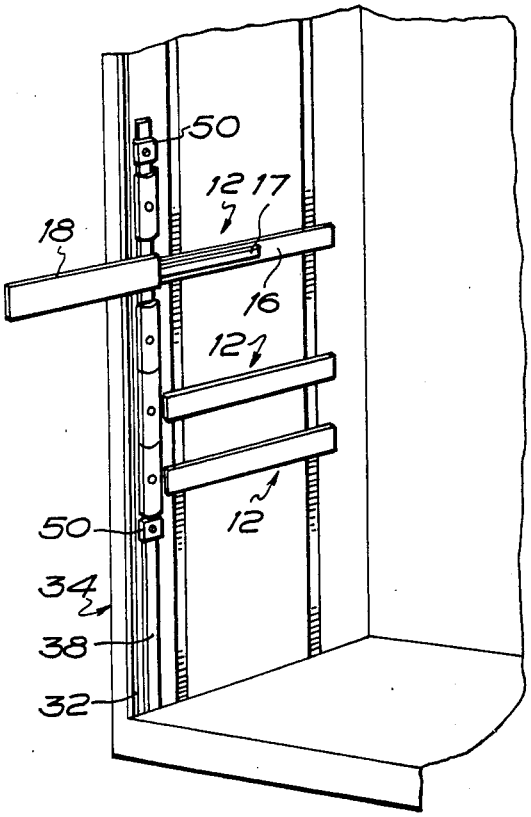
FIG. 7
FIG. 6
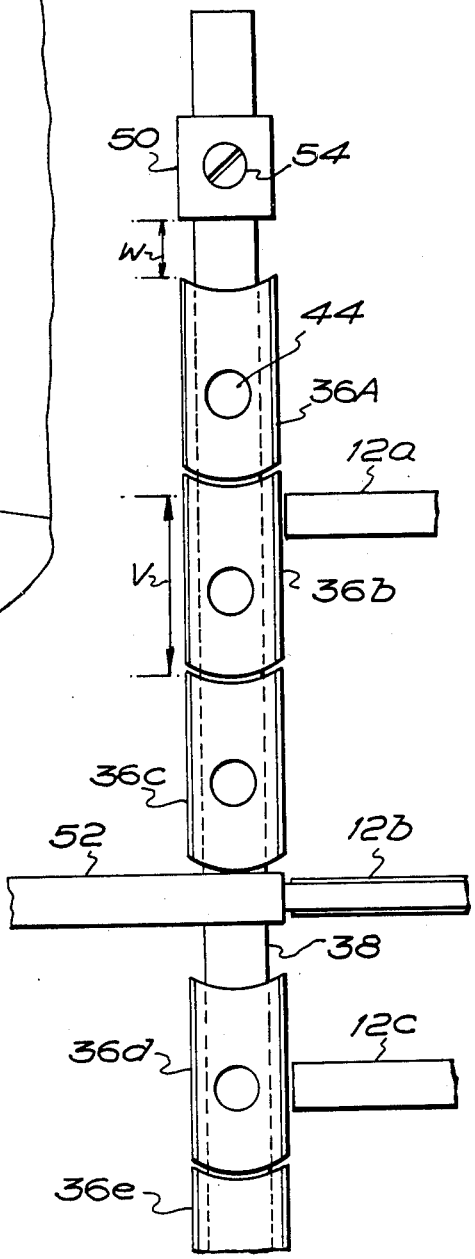

PREVENTING TOPPLING OF CABINETS OR OTHER FURNITURE

FIELD OF THE INVENTION

The present invention relates to cabinets and analogous items of furniture within which there are mounted internal units that can be slid out e.g. for access or use. The invention is particularly applicable to office cabinets, a general term which includes both free-standing and suspended cabinets, carrels, and cupboards with pull-out units. The invention can also be applied to other furniture which has units that can be slid out, including items of laboratory furniture, and kitchen furniture. The furniture does not need to enclose. Open racking can be fitted with units that slide out, and the invention can be applied in this case also.

Cabinets, intended primarily as office furniture, often have units (e.g. working surfaces, drawers, trays etc) which can be slid into and out of the cabinet, but which are fixed to the cabinet, and when slid out remain supported by it, cantilevered out beyond the base of the cabinet. If several of these units are withdrawn simultaneously, and are heavy or carry heavy weight, for example drawers full of office files, there is a serious risk that the cabinet may topple forward, endangering anyone in front of it. To prevent the possibility of such an accident occuring, a safety device may be provided which limits the number of units which can be withdrawn at the same time.

DESCRIPTION OF THE PRIOR ART

Safety devices of this type are known which have a bar extending vertically inside the cabinet, the bar having fittings which co-operate with fittings on the sliding units. Typically the fittings on the bar have projections which engage slots associated with each sliding unit. When all the units are slid into the cabinet, the projections and slots are aligned, and any unit can be slid out. When one unit is withdrawn from the cabinet, the co-operation of a projection with the slot of that unit moves the whole bar vertically so that the remaining projections are no longer aligned with the other slots. It is then not possible to withdraw a second unit because the projections abut against parts adjacent their associated slots.

Known devices of this nature have a number of disadvantages. They are rather complicated and tend, particularly if well made, to be expensive to produce. They cannot be fitted to an already existing cabinet and the presence of the bar reduces the available width within the cabinet, or requires a groove in the side wall of the cabinet.

Some cabinets have provision for fitting internal units at any of a multiplicity of closely spaced positions. Some of the existing known devices cannot be used with such a cabinet, and even those which can be used require adjustment of individual fittings to correspond with the positions selected for sliding units.

SUMMARY OF THE INVENTION

The present invention seeks to provide a safety device which avoids some or all of the above disadvantages, and which can be of very simple construction.

Broadly the present invention provides a safety device comprising a guide, and blocking elements for slidable units of a cabinet. The elements can be moved along the guide to release a unit, but limited free length on the guide restricts the number of sliding units which can be released simultaneously, preferably to one only.

Preferably the blocking elements are solid or hollow blocks.

Pull-out units are customarily fitted to the lower part of a cabinet, and a guide may extend up only the lower part of a cabinet. Whether a guide extends up part only, or the full height of a cabinet, the portion of a guide which is actually needed for sliding blocks is preferably delimited by an end stop adjustably fixed in the guide, or a pair of such stops. Such a stop can be a block fixed in place by means of a clamping screw.

It is envisaged that the present invention would have primary applicability to free-standing cabinets, where there may be a serious risk of toppling. However, the present invention is also applicable to wall mounted cabinets where there is a risk that the mountings of the cabinet may be strained if all the units are pulled out at once.

BRIEF DESCRIPTION OF THE DRAWINGS

Embodiments of the present invention will now be described in detail, by way of example, with reference to the accompanying somewhat diagrammatic drawings in which:

FIG. 6 shows the safety device of FIG. 4 with a different slide released; and,

FIG. 7 is a detail, similar to part of FIG. 1 and showing use of a pair of end stops.

DESCRIPTION OF PREFERRED EMBODIMENTS

Figure 1:
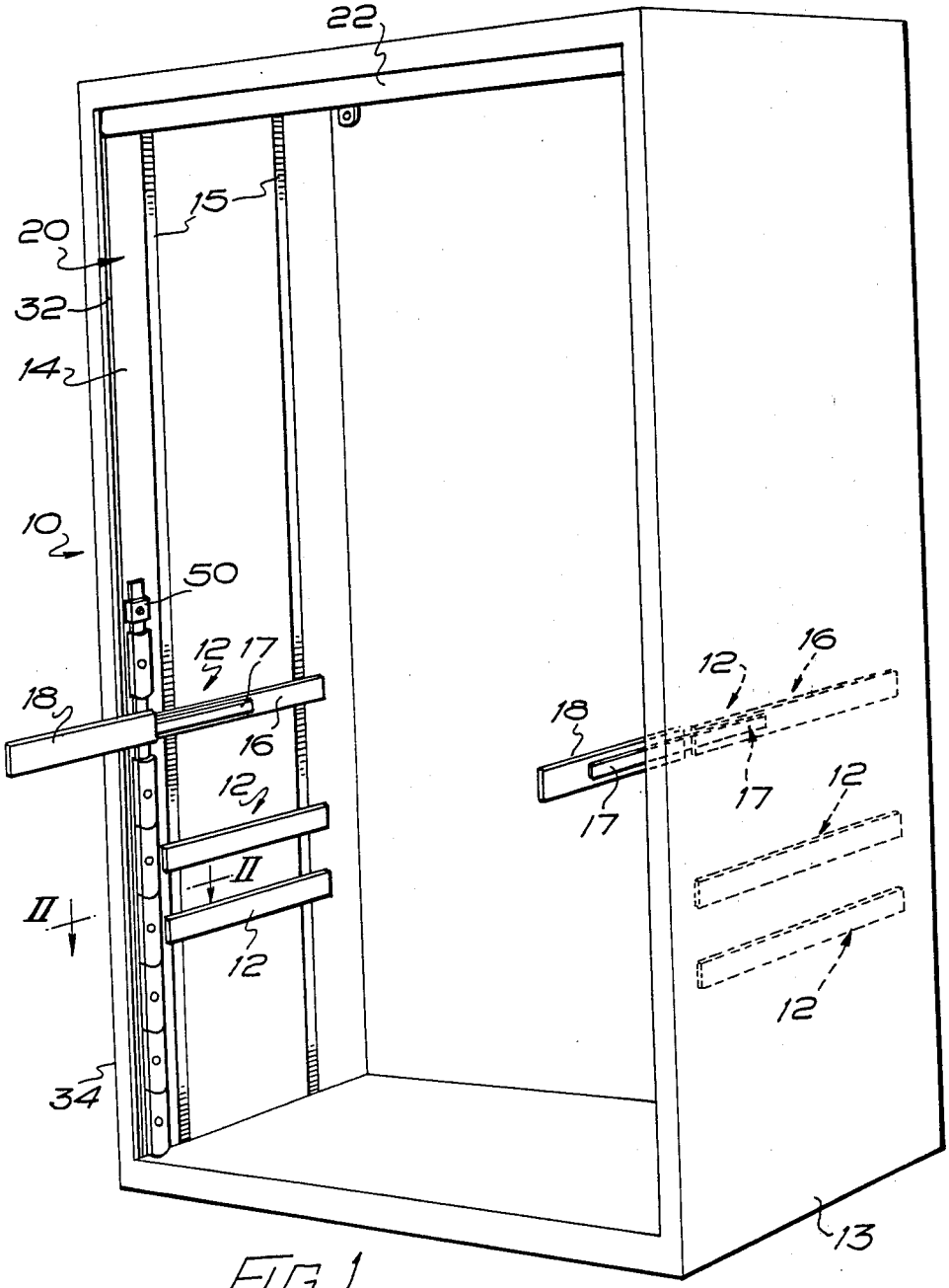
FIG. 1 shows a cabinet according to the present invention.

Referring first to FIG. 1, a cabinet 10 has pairs of slides 12 provided at various heights on its side walls 13, 14. For ease of description, only three such pairs are illustrated but the number used may be chosen to suit the requirements of the use to which the cabinet is put. The slides could be permanently fixed at chosen vertical heights, or attached removably at a limited range of positions dictated by the construction of the cabinet. In this preferred embodiment however, each inner wall of the cabinet has two aligned rows 15 of closely spaced slots, to which the slides can be attached at any of a multiplicity of heights and the heights later changed if desired. The sliders 12 may be of any conventional type. These shown here are of the type with a first part 16 fixed to the cabinet, a second part 17 slidable on the first part, and a third part 18 fixed to the unit and slidable in the second part so that the second part slides out at half the speed of the unit.

The fixed first part 16 of each slide is hooked onto a slot in each of the rows 15. The movable third parts 18 of each pair of slides support between them an internal unit 19 (FIG. 2) of the cabinet 10. This unit 19 is fixed to the parts 18.

Figure 2:
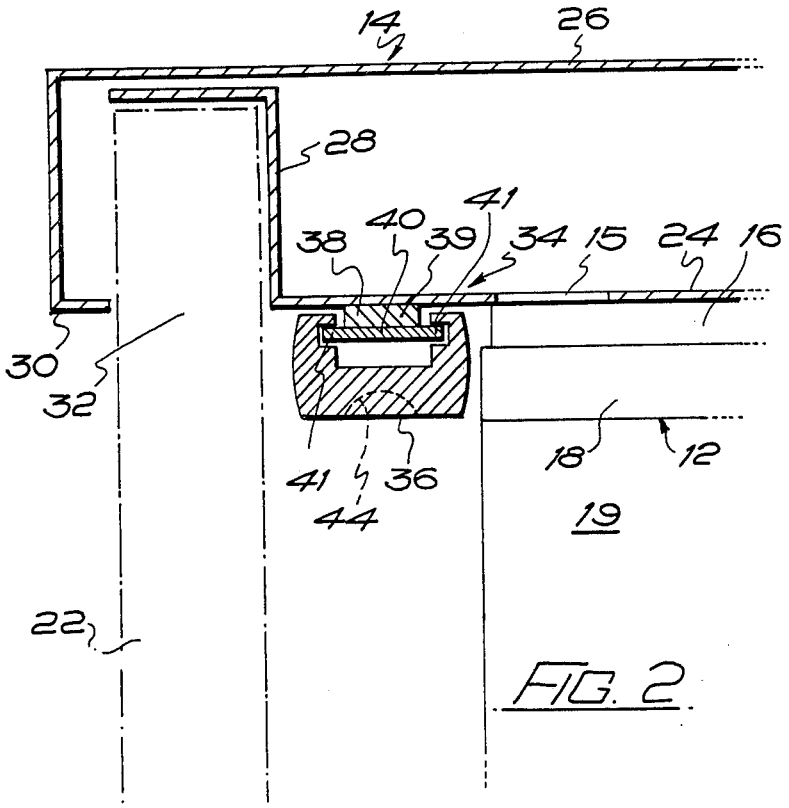
FIG. 2 is a section plan view of a corner of the cabinet of FIG. 1, on the line II—II of FIG. 1.

The internal unit extends across the width of the cabinet and may be, for example, a pull-out shelf to provide a writing surface, a tray, a filing frame for suspended files, or a drawer. By virtue of its pair of slides 12 the unit 19 may be slid into and out of the cabinet 10, through the entrance 20 to the cabinet. This entrance 20 may be closed by hinged doors or by a vertically-opening roller shutter, also known as a tambour 22 the position of which is shown in FIG. 2. When slid out, a unit 19 is still supported by the cabinet, cantilevered out beyond the cabinet's floor area.

As best seen from FIG. 2, the cabinet 10 is made of steel plate, the sides 13, 14 each having an inner plate 24 and an outer plate 26. The inner plate 24 has a flange 28 extending between the inner and outer plates 24,26 and, together with a folded-over portion 30 of the outer plate, forms a channel 32 for the edge of the tambour 22.

Situated on the left side of the cabinet in a space between the tambour 22 and the fixed parts 16 of the slides 12 is a safety device 34, consisting of a number of blocks 36 slidably mounted on an upright guide 38. When the tambour 22 is lifted, the safety device 34 is freely accessible allowing manual operation of it. If the cabinet had hinged doors in place of a tambour, the safety device 34 would be accessible when the doors are opened.

Figure 3:
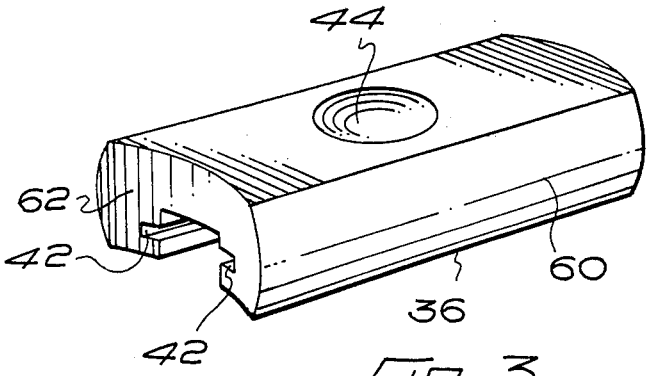
FIG. 3 shows an example of a block for use in the safety device of the cabinet of FIGS. 1 and 2.

The guide 38 has a flattered T shape in cross section and is formed from two superimposed steel strips 39, 40 spotwelded together. The strips can for example be a 23 mm wide outer strip 40 of 20 s.w.g. steel superimposed on a 14 mm wide inner strip 39 of 16 s.w.g. steel. The projecting margins 41 of the outer strip 40 engage slots 42 in each block 36 (FIG. 3) and allow the block 36 to be freely slidable on the guide 38. A finger hole 44 is provided in each block 36 to enable the block to be slid along the guide easily.

The blocks 36 are conveniently made from plastics material e.g. polyamide such as is known as "nylon" as this gives silent sliding along the guide, with very little friction.

The guide 38 is sufficiently slender that the moving parts 17, 18 of the slides are not obstructed by it and yet the fixed parts 16 of the slides are mounted directly on the inner wall 24. Thus the safety device does not restrict the width available in the cabinet.

The guide 38 may be attached to the cabinet 10 during manufacture of the latter, or may be fitted to an already existing cabinet. If the guide 38 is fitted during manufacture, it may be secured to the inner wall 24 of the cabinet 10 by rivets. When it is fitted to an existing cabinet "in situ", it may be possible to use rivets, or the guide 38 may be fitted using self-tapping screws.

The blocks 36 project out sufficiently far to block the sliding-out of the moving part 18 of any slide which has a block 36 aligned with it. As shown in FIG. 1 the total length of the blocks 36 engaged on guide 38 is slightly less than the length of the guide 38. An end stop 50 is provided and this restricts the free length to about the length of one block 36. This allows movement of the blocks 36 and of course prevents the blocks 36 from being removed from the top of the guide 38.

Operation of the safety device 34 will be described with reference to FIGS. 4 to 6 which show in elevation the upper five blocks 36*a* to 36*e* on guide 38, and the top three slides 12 at the left of the cabinet.

Figure 4:
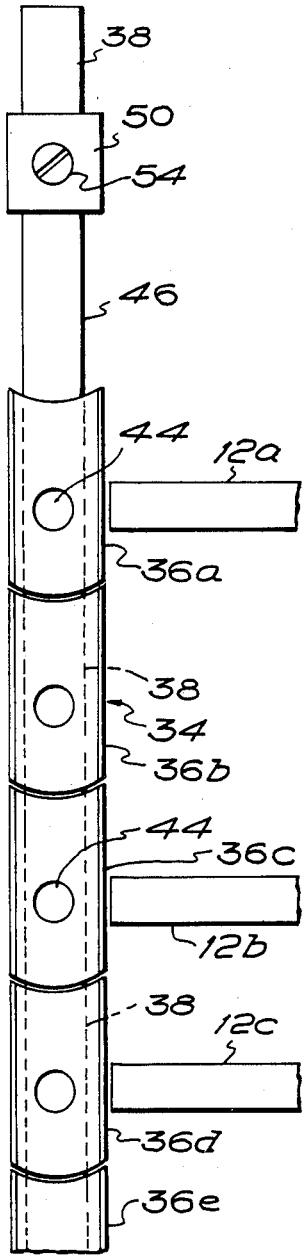
FIG. 4 shows the upper part of a safety device for the cabinet of FIG. 1 with all slides blocked.
Figure 5:
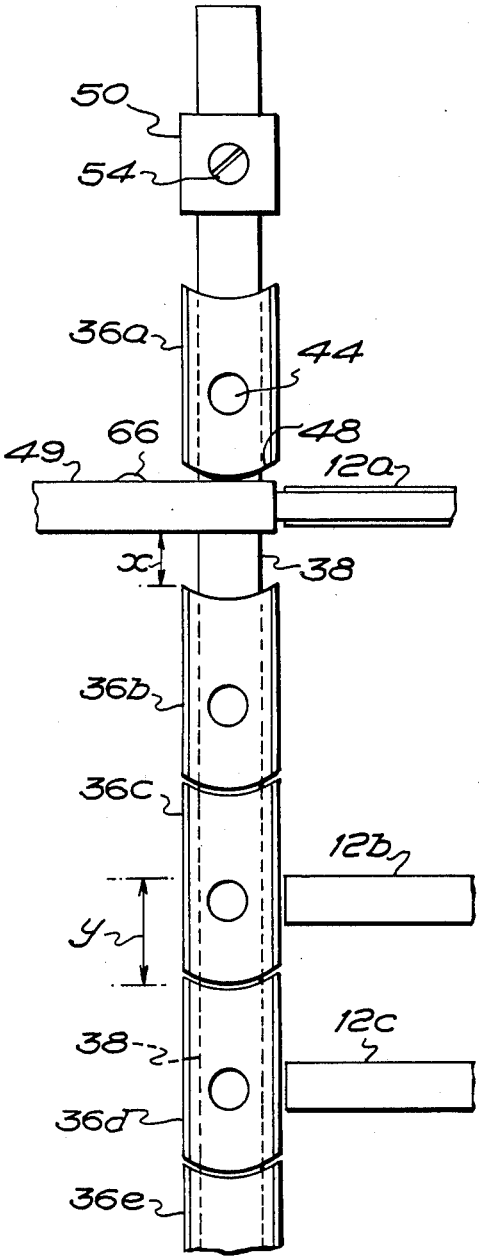
FIG. 5 shows the safety device of FIG. 4 with one slide released.

FIG. 4 shows the "closed" position, with all sliding units retracted into the cabinet and the blocks 36 extending upwardly from the bottom of the guide 38 in a continuous column. The blocks extend to above the uppermost slide 12*a* and so all the slides 12 are blocked and none of the units 19 may be slid out of the cabinet 10. The free length of the guide 38 extends upwardly from the top of the stack of blocks 36 and is indicated at 46.

If it is desired to release the upper slide 12*a*, the upper block 36*a* is raised by hand up the guide 36 until its bottom edge 48 is above the slide 12*a* and the unit 19 thereon. The unit 19 on the slide 12*a* is then slid out of the cabinet 10 and the upper block 36 is allowed to drop down onto the upper edge 49 (as shown in FIG. 5).

In this position it is not possible to release the slide 12*b* because the free distance x between the top of the second block 36*b* and the bottom of the upper slide 12*a* is less than the distance y that the blocks 36*b* and 36*c* would have to be raised to release slide 12*b*. Similarly, slide 12*c*, and any lower slide, cannot be released.

If the unit on slide 12*a* is slid back into the cabinet 10, the upper block 36*a* falls back onto the second block 36*b* and the safety device 3 resumes its "closed" position.

All the blocks 36 are freely slidable so that it is a simple matter to raise a group of blocks by manually lifting the lowest of the group. Thus by raising block 36*c*, (and blocks 36*a* and 36*b* with it) the slide 12*b* may be released, and slid out, after which these three blocks rest on the upper edge 52 of the lower slide 12*b*. The upper slide 12*a* is then blocked. The distance v that the blocks 36*a* and 36*b* would have to be raised to free the upper slide 12*a* is larger than the distance w from the top 32 of the upper block 36*a* to the top of the guide 38. Hence it is not possible to release the upper slide 12*a*. The slide 12*c* is also blocked, as is any lower slide.

In theory at least, the uppermost slide may be above the level of the blocks when they are in the closed position, but below the top of the guide. The upper unit could then be slid out freely without it being necessary to move any of the blocks, the other slides being blocked. To release one of the lower slides, the blocks above it would be slid up the guide thereby releasing that slide and simultaneously blocking all the other slides, including the uppermost slide.

As shown in FIG. 1 the blocks 36 are all of equal length, and the free length remaining on the guide 38 is about the length of one block 36. However, the blocks 36 need not necessarily all be the same length. Some blocks of shorter length could be incorporated if desired. The sizes used, and the amount of free length remaining on the guide can be varied to suit the particular application.

It is customary to install sliding units up to but not substantially above 54 inches (1 meter 37 cm) from floor level. It would be possible to use a standard length of guide 38 for all cabinets of greater height than this, although the length of the guide 38 and/or the lengths and number of blocks thereon can be tailored to individual applications if desired.

A guide of standard length could be provided in every case, and always fitted with a standard number of blocks 36 on the guide, with the lowest block resting on the floor of the cabinet when all the slides are retracted. Alternatively, however, a length of guide can be bounded by a pair of the end stops 50 as shown in FIG. 7. These end stops 50 are short blocks provided with grooves 42 so that they can be slid on the guide 38 and tapped to receive a set screw 54 by which they can be clamped to the guide 38. This enables the positions of such stops to be chosen freely. Desirably their positions are chosen to bring the blocks 36 into proper alignment with the positions of the slides 12, which can be fitted at any of a multiplicity of closely spaced positions provided by the rows 15 of closely spaced slots.

If an end stop 50 is not used the top of the guide 38 can be deformed, e.g. by a spot weld, to prevent the block 36 from being slid off it.

The blocks 36 have slightly bowed side faces 60 and curved top and bottom faces 62,64. The top face is indicated by numeral 62. The top and bottom faces have the same curvature enabling the bottom of one block to fit closely against the top of the one below when resting on it.

The curved bottom face allows the user of a cabinet to drop the raised blocks onto the top edge of a slide while it is still being pulled out. Then as outward movement continues the curved bottom surface enables the blocks to rise up over any small protuberances on the slide. Likewise when the slide is pushed back in it is not necessary to raise the blocks at all: they merely rise up over these protuberances as the slide is pushed back in. To assist this riding over protuberances, the top edges on which blocks rest may be arranged to that any protuberances have sloping leading and trailing faces, to co-operate with the curved bottom face of the block 36. This is illustrated in FIG. 5. The curved bottom edge 48 of block **36*a* enables it to ride over the protuberance 66 which is also curved and the slide can be pushed back in without having to lift the block 36*a***.

The unit 19 which extends across the cabinet may be fastened onto and lie between, the confronting faces of two slides' parts 18 in which case the bottom of a block 36 would rest on the moving parts of these slides. Alternatively the unit 19 may rest on top of the parts 18 of its slides, and the block 36 will then rest on a top edge of the unit 19.

Various modifications may be made to the safety device described. Although it is preferred that the blocks 36 are made of plastics material they could be made from steel, or from hardwood. Also, plastics materials other than nylon could be employed. The guide 38 could be of plastics material, e.g. nylon, instead of steel. Yet again it could be of steel, but have a channel section.

As an alternative to the rectangular end stops 50 which are shown in the drawings, a rather neater end stop can be made by modifying a block 36. At the central position (which would otherwise be occupied by the finger hole 44) a threaded nut insert is permanently fitted into the block. The set screw 54 is received in this. This type of end stop is neater because it nests with the slidable blocks 36, and is cheaper because only one moulded component is required.

The cabinet described has hollow steel side walls but it will be appreciated that the safety device 34 could also be applied to side walls made of a wood-based board, such as laminate-covered blockboard or chipboard.

I claim:

1. An article of furniture having a plurality of internal units mounted so as to be slidable out of the article, and a safety device restricting the total number of said units slidable out concurrently yet permitting the sliding out of any chosen one of said units while so restricting the total number, said safety device comprising:

a guide adapted to be positioned on the article so as not to obstruct sliding out of said units, and a plurality of blocking elements slidably mounted on the guide and projecting from the guide to block the sliding out of said units, the blocking elements being displaceable relative to each other lengthwise along the guide, displacement of at least one blocking element relative to the remining blocking elements creating a gap between successive blocking elements to permit the sliding out of a chosen unit through said gap, the length of said guide available to the blocking elements and the number and total length of said blocking elements thereon being such that said blocking elements occupy less than the total length of the guide available to the blocking elements and leave a remaining free length which is sufficiently great such that when none of said slidable units has been slid out, any blocking elements in the path of any one of the slidable units can be displaced far enough along the guide to create a gap for that unit to be slid out, said free length of the guide being sufficiently limited to restrict the creation of gaps between successive blocking elements and thereby restrict the number of said slidable units which can be slid out concurrently.

2. An article of furniture according to claim 1 wherein the safety device permits no more than one slidable unit to be slid out at any time.

3. An article of furniture according to claim 1 wherein the guide is located on a side wall of the article inside an entrance to the article and adjacent thereto.

4. An article of furniture according to claim 1 wherein each blocking element is a block provided with at least one finger hole.

5. An article of furniture according to claim 1 wherein each blocking element is a block made of plastics material.

6. An article of furniture according to claim 1 wherein the guide is located on a side wall of the article and has a pair of outward projections spaced from the wall of the article of furniture, the projections engaging slots in each block.

7. An article of furniture according to claim 1 wherein the side walls thereof have a multiplicity of formations to which sliding units can be attached, these formations being at a spacing of no more than 50 mm.

8. An article of furniture according to claim 1 which is a free-standing cabinet.

9. An article of furniture according to claim 1 having at least one end stop adjustably secured to the guide to limit the travel of the blocking elements thereon.

10. A system of parts assemblable into articles of furniture according to claim 1 and comprising enclosures, internal units mountable therein to be slidable out of such enclosures, said guides mountable on such enclosures and said blocking elements mountable on said guides.

11. An article of furniture according to claim 1 wherein said guide is an upright guide located inside an entrance to the article and adjacent thereto, each blocking element being a block manually slidable along the guide, and the blocking elements forming a stack in front of said slidable units, at least the top block on the stack being slidable up the guide to create a gap in the stack for sliding out any selected unit blocked by the stack.

* * * * *